US009874841B2

(12) United States Patent
Takagi et al.

(10) Patent No.: US 9,874,841 B2
(45) Date of Patent: Jan. 23, 2018

(54) FIXING DEVICE THAT STABLY ENSURES CLEARANCE BETWEEN SEPARATING MEMBER AND FIXING ROLLER, AND IMAGE FORMING APPARATUS THAT INCLUDES THE SAME

(71) Applicant: KYOCERA Document Solutions Inc., Osaka (JP)

(72) Inventors: Masaru Takagi, Osaka (JP); Masami Fuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/490,461

(22) Filed: Apr. 18, 2017

(65) Prior Publication Data

US 2017/0371284 A1 Dec. 28, 2017

(30) Foreign Application Priority Data

Jun. 22, 2016 (JP) ..... 2016-123469

(51) Int. Cl.
*G03G 15/20* (2006.01)

(52) U.S. Cl.
CPC ..... *G03G 15/2085* (2013.01)

(58) Field of Classification Search
CPC ..... G03G 15/2028; G03G 15/2085
USPC ..... 399/122, 323
See application file for complete search history.

(56) References Cited

U.S. PATENT DOCUMENTS 6,782,229 B2 * 8/2004 Kurisu ..... G03G 15/2064 399/323
8,515,312 B2 * 8/2013 Yamada ..... G03G 15/2028 399/122
8,892,014 B2 * 11/2014 Yokoyama ..... G03G 15/2035 399/323
8,909,074 B2 * 12/2014 Yamada ..... G03G 15/2085 399/122

FOREIGN PATENT DOCUMENTS

JP 2014-202851 A 10/2014

* cited by examiner

*Primary Examiner* — William J Royer
(74) *Attorney, Agent, or Firm* — Stein IP, LLC

(57) ABSTRACT

A fixing device includes a fixing member that is heated, a pressure member, a fixed housing, a movable housing, a moving mechanism, a separating member, a regulating portion, and a link member. The link member is interposed between the movable housing and the separating member. In a pressurized state, the separating member turns about a support shaft in a direction where the separating member approaches to the fixing member by its own weight of the separating member. When a fixing pressure is switched from the pressurized state to a reduced pressure state, moving the movable housing in the direction where the movable housing separates from the fixed housing by the moving mechanism causes the separating member to turn about the support shaft via the link member in the direction where the separating member separates from the fixing member and causes the regulating portion to regulate turning of the separating member.

6 Claims, 16 Drawing Sheets

FIXING DEVICE THAT STABLY ENSURES CLEARANCE BETWEEN SEPARATING MEMBER AND FIXING ROLLER, AND IMAGE FORMING APPARATUS THAT INCLUDES THE SAME

INCORPORATION BY REFERENCE

This application is based upon, and claims the benefit of priority from, corresponding Japanese Patent Application No. 2016-123469 filed in the Japan Patent Office on Jun. 22, 2016, the entire contents of which are incorporated herein by reference.

BACKGROUND

Unless otherwise indicated herein, the description in this section is not prior art to the claims in this application and is not admitted to be prior art by inclusion in this section.

A typical image forming apparatus such as a copier and a printer includes a fixing device that fixes a toner image transferred on a paper sheet on the paper sheet. A fixing device includes a fixing roller and a pressure roller that form a fixing nip by being brought into pressure contact with one another. A toner image undergoes heating and pressurization to be fixed on a paper sheet when the paper sheet passes through the fixing nip.

In such a fixing device, a paper sheet sometimes winds around a fixing roller after passing through a fixing nip. Accordingly, to prevent winding of the paper sheet, the fixing device includes a separating member that separates the paper sheet from the fixing roller after the paper sheet passes through the fixing nip. The separating member includes a separation plate that faces an outer peripheral surface of the fixing roller and a contact member that holds the separation plate with a predetermined clearance from the outer peripheral surface. The contact member forms the clearance between the separation plate and the outer peripheral surface by being brought into contact with the outer peripheral surface in a non-paper passing region, which is outside a paper passing region of the fixing roller.

Thus, since the contact member always contact the fixing roller, the contact portion with the contact member of the fixing roller fiercely wears. Use of an IH as a heat source may cause a fixing member to be driven even during waiting because of heat equalization for the fixing roller and thus may cause wear to further progress. In view of this, a fixing roller using a fixing belt causes a failure of the fixing belt.

Meanwhile, passing a special paper such as an envelope requires reduction of a fixing pressure of the fixing nip. In view of this, the fixing roller and the pressure roller are separably located such that the fixing pressure is switchable between a pressurized state and a reduced pressure state. Even in such reduced pressure state, a predetermined clearance needs to be allocated between the outer peripheral surface of the fixing roller and the separation plate. An unstable clearance may cause a paper-passing-through failure where a distal end of an envelope is caught by a distal end of the separation plate.

There is known a fixing device configured to separate a contact member from a fixing roller during switching a fixing pressure from a pressurized state to a reduced pressure state. This fixing device is configured to switch the fixing pressure by moving the fixing roller with respect to the pressure roller. Then, during movement of the fixing roller in switching of the fixing pressure from the pressurized state to the reduced pressure state, a movable frame that supports the fixing roller interferes with the contact member to separate the contact member from the fixing roller.

SUMMARY

A fixing device according to one aspect of the disclosure includes a fixing member that is heated, a pressure member, a fixed housing, a movable housing, a moving mechanism, a separating member, a regulating portion, and a link member. The pressure member forms a fixing nip with the fixing member. The fixed housing rotatably supports the fixing member. The movable housing rotatably supports the pressure member and is separably located with respect to the fixed housing. The moving mechanism moves the movable housing in a direction where the movable housing approaches to or separates from the fixed housing and switches a fixing pressure of the fixing nip between a pressurized state and a reduced pressure state. The separating member is turnably supported by the fixed housing about a support shaft in a direction where the separating member approaches to or separates from the fixing member and separates a paper sheet that has passed through the fixing nip from the fixing member. The regulating portion is located in the fixed housing and regulates turning of the separating member in a direction where the separating member separates from the fixing member. The link member is interposed between the movable housing and the separating member. In the pressurized state, the separating member turns about the support shaft in a direction where the separating member approaches to the fixing member by its own weight of the separating member. When the fixing pressure is switched from the pressurized state to the reduced pressure state, moving the movable housing in the direction where the movable housing separates from the fixed housing by the moving mechanism causes the separating member to turn about the support shaft via the link member in the direction where the separating member separates from the fixing member and causes the regulating portion to regulate turning of the separating member.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 6A illustrates a pressurized state, and FIG. 6B illustrates a reduced pressure state;

FIG. 8A illustrates a side view viewed from a front side, and FIG. 8B illustrates VIIIB-VIIIB arrow view of FIG. 7;

DETAILED DESCRIPTION

Figure 1:
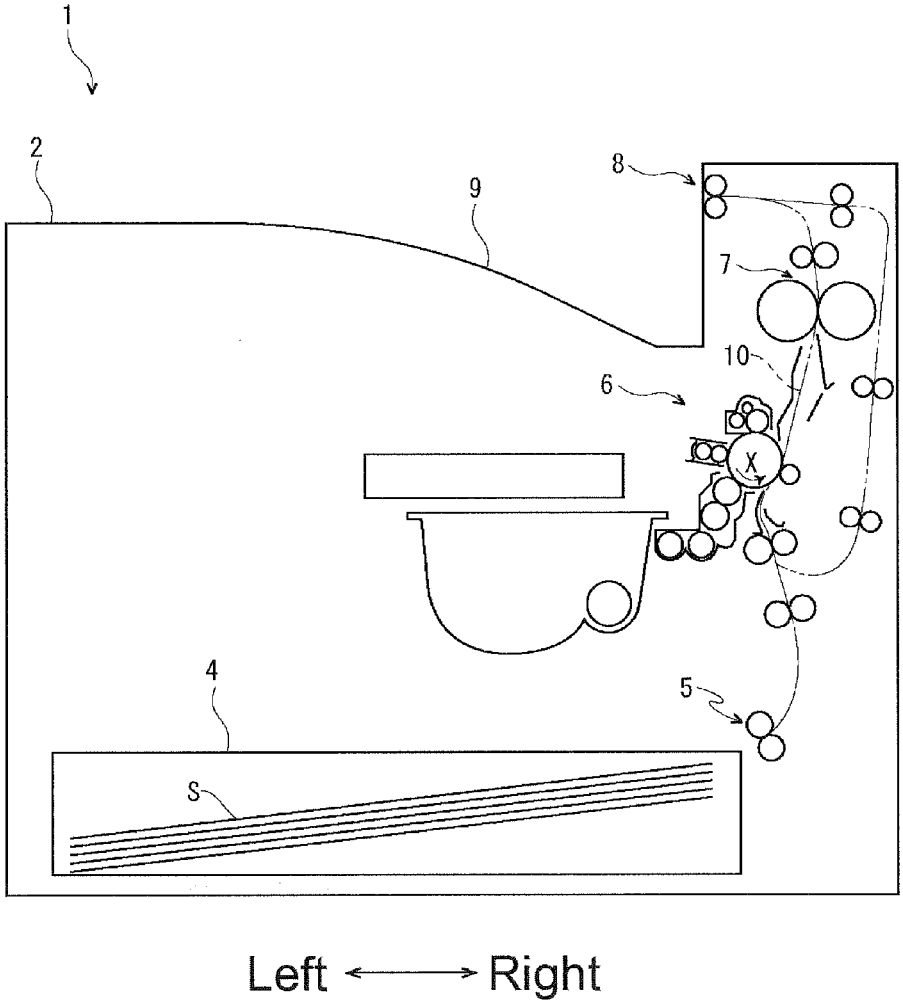
FIG. 1 schematically illustrates an outline of a printer according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes a fixing device and an image forming apparatus according to an embodiment of the disclosure with reference to the drawings.

First, a description will be given of an overall structure of a printer 1 (image forming apparatus) by using FIG. 1. FIG. 1 schematically illustrates an outline of the printer 1 according to one embodiment of the disclosure. In the following description, assume that a front side on the paper in FIG. 1 is a front face side (front side) of the printer 1, and a lateral direction is based on the direction when viewing the printer 1 from the front face.

An apparatus main body 2 of the printer 1 includes a sheet feed cassette 4, a paper feeder 5, an image forming unit 6, a fixing device 7, a discharge unit 8, and a sheet discharge tray 9. The sheet feed cassette 4 houses a sheet S. The paper feeder 5 conveys the sheet S from the sheet feed cassette 4. The image forming unit 6 forms a toner image on the sheet S. The fixing device 7 fixes the toner image on the sheet S. The discharge unit 8 discharges the sheet S with the toner image fixed. The sheet discharge tray 9 receives the discharged sheet S.

The sheet feed cassette 4 is located to be removably attachable in a lower portion of the apparatus main body 2. The paper feeder 5 is arranged above a right end portion of the sheet feed cassette 4. The image forming unit 6 is located above the sheet feed cassette 4. The fixing device 7 is arranged above a right end portion of the image forming unit 6, and the discharge unit 8 is arranged above an upper left of the fixing device 7. The sheet discharge tray 9 is formed on a top surface of the apparatus main body 2. Furthermore, in the apparatus main body 2, a conveying path 10 for a paper sheet, which passes through the image forming unit 6 and the fixing device 7 from the paper feeder 5 to head for the discharge unit 8, is formed.

The paper sheet S is conveyed to the conveying path 10 from the sheet feed cassette 4 by the paper feeder 5, and the image forming unit 6 forms a toner image on the paper sheet S. The toner image is fixed on the paper sheet S by the fixing device 7. The paper sheet S on which the toner image is fixed is discharged to the sheet discharge tray 9 by the discharge unit 8.

Figure 2:
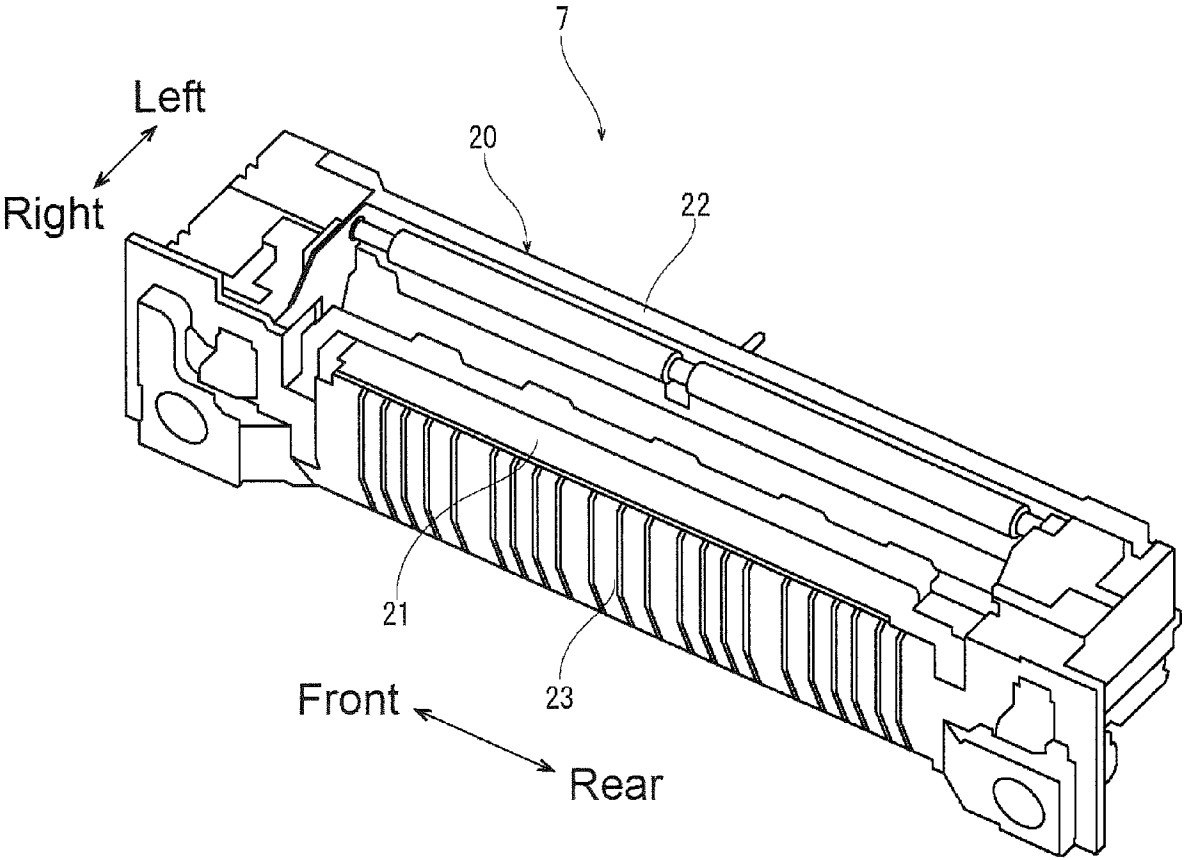
FIG. 2 obliquely illustrates a fixing device according to the one embodiment.
Figure 3:
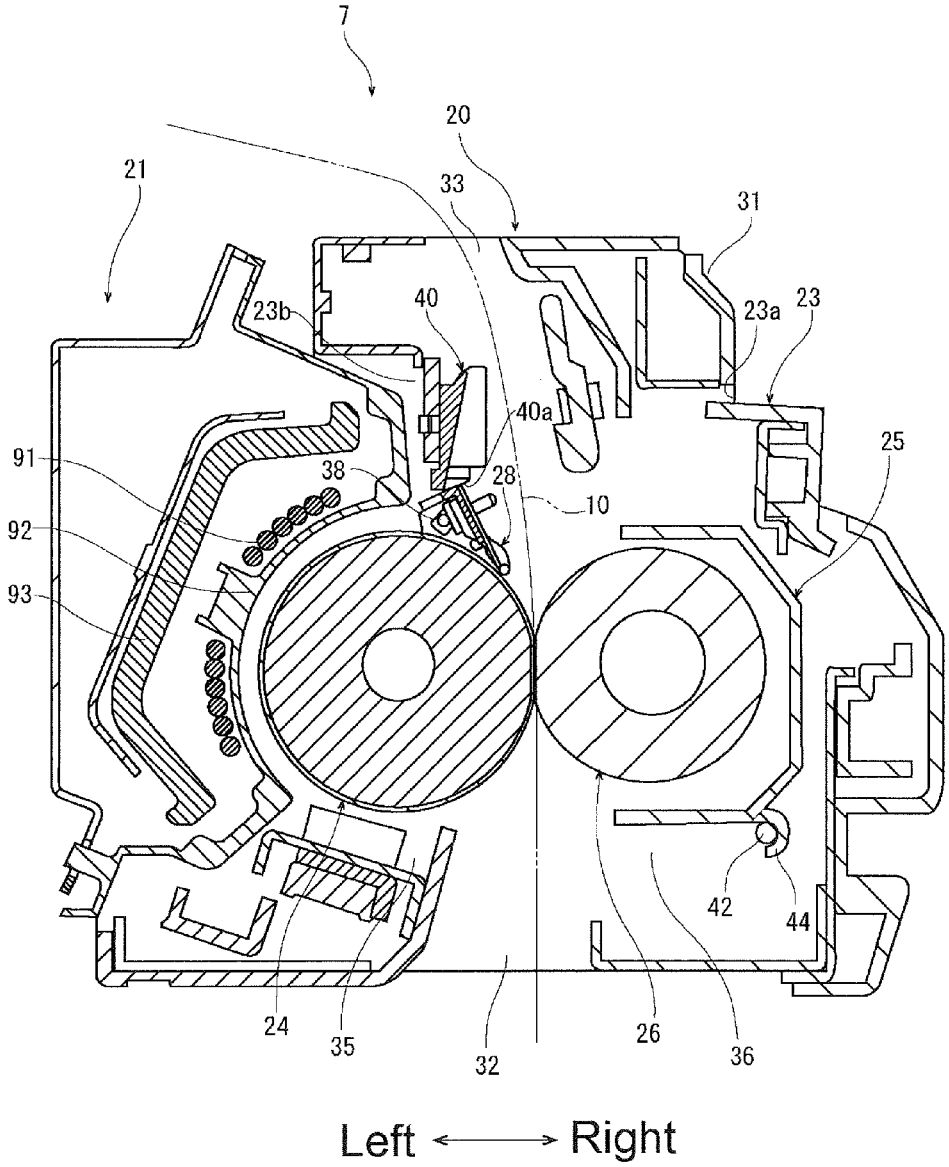
FIG. 3 illustrates a side cross-sectional view illustrating a fixing device according to the one embodiment.

Next, a description will be given of the fixing device 7 with reference to FIGS. 2 and 3. FIG. 2 obliquely illustrates the fixing device 7, and FIG. 3 illustrates a cross-sectional view of the fixing device 7. As illustrated in FIGS. 2 and 3, the fixing device 7 includes a fixing unit 20 and an IH unit 21 that is arranged on a left side of the fixing unit 20.

First, a description will be given of the fixing unit 20. As illustrated in FIG. 2, the fixing unit 20 has an approximately rectangular parallelepiped shape that is long in a front-rear direction. As illustrated in FIG. 3, the fixing unit 20 includes: a fixed housing 23; a fixing roller 24 as a fixing member rotatably supported by the fixed housing 23; a movable housing 25 movably supported by the fixed housing 23; a pressure roller 26 as a pressure member rotatably supported by the movable housing 25; and a moving mechanism 27 (see FIGS. 6A to 6B described below) that moves the movable housing 25 in a direction approaching or separating with respect to the fixed housing 23. Furthermore, the fixing unit 20 includes a separating member 28 turnably supported by the fixed housing 23 and a link member 29 (see FIG. 9 and similar drawing described later) interposed between the separating member 28 and the movable housing 25.

As illustrated in FIGS. 2 and 3, the fixed housing 23 is a hollow member having an approximately rectangular parallelepiped shape that is long in the front-rear direction and includes openings 23*a* and 23*b* on its top surface and left side surface, respectively. A cover plate 31 is openably/closably mounted to the opening 23*a* on the top-surface. In a bottom plate of the fixed housing 23 and the cover plate 31, a paper-sheet-receiving port 32 and a paper-sheet-discharge port 33 are formed along the front-rear direction, in an approximately center in a lateral direction, respectively. The conveying path 10 for the paper sheet S is formed between the paper-sheet-receiving port 32 and the paper-sheet-discharge port 33.

In a hollow portion of the fixed housing 23, a fixing-roller-housing concave portion 35 that supports the fixing roller 24 is formed on a left side of the conveying path 10, and a movable-housing-containing concave portion 36 that houses the movable housing 25 is formed on a right side of the conveying path 10.

In the fixing-roller-housing concave portion 35, a pair of front and rear pivotally supporting portions (not illustrated) that supports the fixing roller 24 is coaxially formed. Furthermore, above the pair of front and rear pivotally supporting portions, a pair of front and rear support shafts 38, which is parallel to the pivotally supporting portions, is coaxially located upright, respectively. The pair of front and rear support shafts 38 rotatably supports the separating member 28, which will be described later. In the fixing-roller-housing concave portion 35, a regulating portion 40 is located in an upper-edge-front-end portion of the opening 23*b* on the left side surface. In the regulating portion 40, a regulating surface 40*a* facing oblique-lower-right side is formed, above the support shaft 38 viewed from an axial direction of the support shaft 38.

The fixing roller 24 includes an elastic layer located on a rotation shaft and an outer peripheral surface of the rotation shaft and a fixing belt secured to an outer peripheral surface of the elastic layer. The rotation shaft is formed of, for example, stainless steel or aluminum. The elastic layer is formed of, for example, silicon rubber or silicon sponge. The fixing belt has a base material layer, an elastic layer that is located on a surface of the base material layer, and a release layer that coats the elastic layer. The base material layer is formed of metal such as Nickel. The elastic layer is formed of, for example, silicon rubber or silicon sponge. The release layer is formed of, for example, fluororesin.

The fixing roller 24 has a paper passing region and a non-paper passing region. The paper passing region corresponds to a maximum width of the paper sheet, which is passed through. The non-paper passing region is both outsides of the paper passing region in a width direction perpendicular to a conveyance direction of the paper sheet S.

Both ends of a rotation shaft of the fixing roller 24 are rotatably supported by the pair of front and rear pivotally supporting portions formed in the fixing-roller-housing concave portion 35. Thus, supporting the fixing roller 24 exposes a part of an outer peripheral surface of the fixing roller 24 from the opening 23*b* on the left side surface of the fixed housing 23. One end of the rotation shaft protrudes outside from the fixing-roller-housing concave portion 35 to be connected to a driving source such as a motor. Driving of the driving source rotates the fixing roller 24 about the rotation shaft in a counterclockwise direction in FIG. 3.

A pair of front and rear pivotally supporting pins 42 (see FIG. 3) is located upright in a lower portion of the movable-housing-containing concave portion 36. As described above, the movable housing 25, in which the pressure roller 26 is rotatably supported, is housed in the movable-housing-containing concave portion 36.

Figure 4:
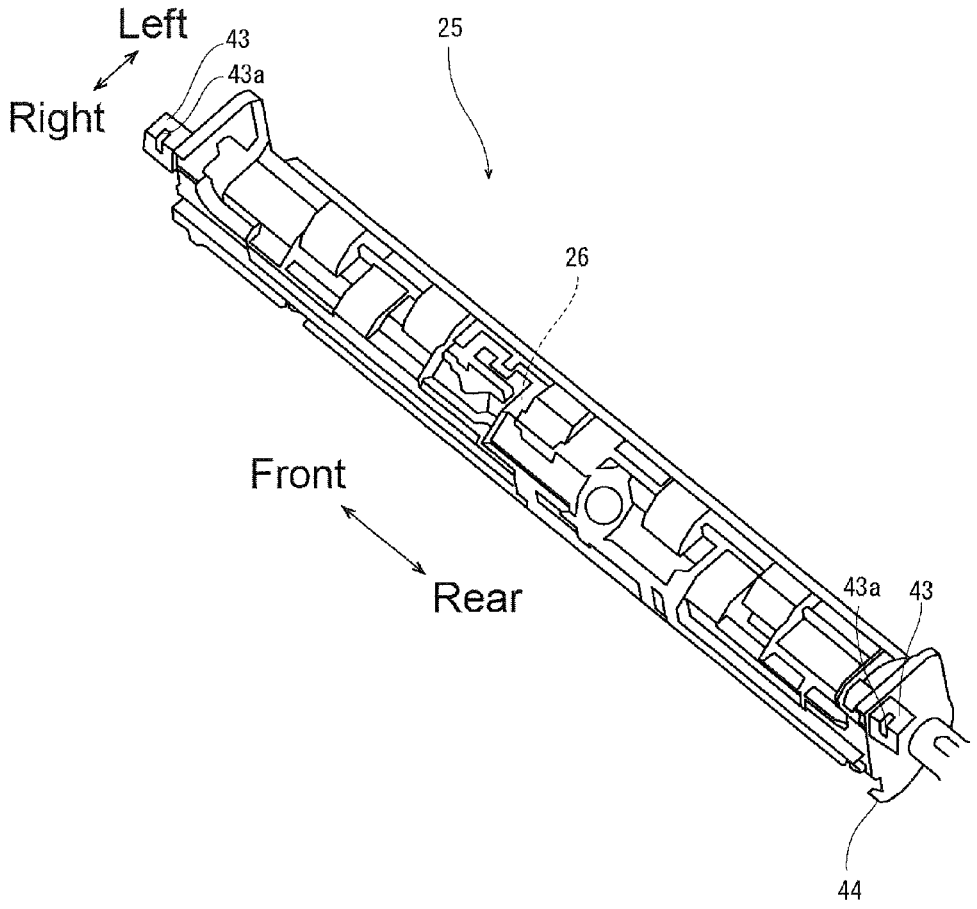
FIG. 4 obliquely illustrates a movable housing in the fixing device according to the one embodiment.
Figure 5:
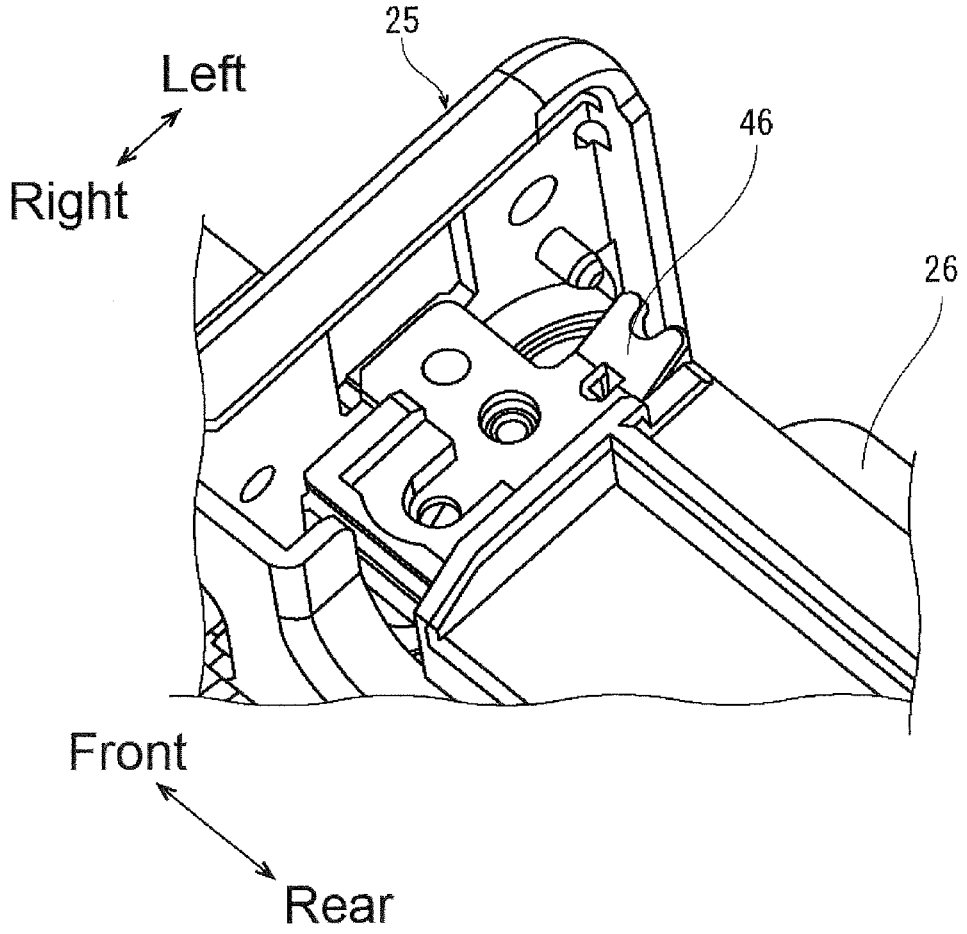
FIG. 5 obliquely illustrates a front-end portion of the movable housing in the fixing device according to the one embodiment.

A description will be given of the movable housing 25 and the pressure roller 26 with reference to FIGS. 4 to 5. FIG. 4 obliquely illustrates the movable housing 25, and FIG. 5 obliquely illustrates a front-end portion of the movable housing 25.

The movable housing 25 is a hollow-shaped member having a hollow portion that houses the pressure roller 26 and has a left side surface that opens. As illustrated in FIG. 4, a connection piece 43 is located on each of the front-end surface and a rear-end surface of the movable housing 25. The connection piece 43 is L-shaped in a cross-sectional view, and an opening 43*a* is formed in its bending portion. Furthermore, a hook piece 44 is located on each of lower edges of the front-end surface and the rear-end surface. As illustrated in FIG. 5, a spring mounting portion 46 is located in the front-end portion on a top surface of the movable housing 25.

The pressure roller 26 includes a rotation shaft, an elastic layer located on an outer peripheral surface of the rotation shaft, and a release layer that covers an outer peripheral surface of the elastic layer. The rotation shaft is formed of, for example, stainless steel or aluminum. The elastic layer is formed of, for example, silicon rubber or silicon sponge. The release layer is formed of, for example, fluororesin. The pressure roller 26 is turnably housed about the rotation shaft in the hollow portion of the movable housing 25, and a part of its outer peripheral surface is exposed from the opening of the left side surface.

As illustrated in FIG. 3, by engaging each hook piece 44 to the pair of front and rear pivotally supporting pins 42 formed in the movable-housing-containing concave portion 36, the movable housing 25 that houses the pressure roller 26 is turnably supported about the pivotally supporting pin 42 by the movable-housing-containing concave portion 36. Turning of the movable housing 25 about the pivotally supporting pin 42 in the counterclockwise direction in FIG. 3 causes the pressure roller 26, which is exposed from the left side surface opening of the movable housing 25, to be brought into press-contact with the fixing roller 24 to form a fixing nip between the pressure roller 26 and the fixing roller 24. On the other hand, the turning of the movable housing 25 in the clockwise direction in FIG. 3 causes the pressure roller 26 to separate from the fixing roller 24.

Figure 6A:
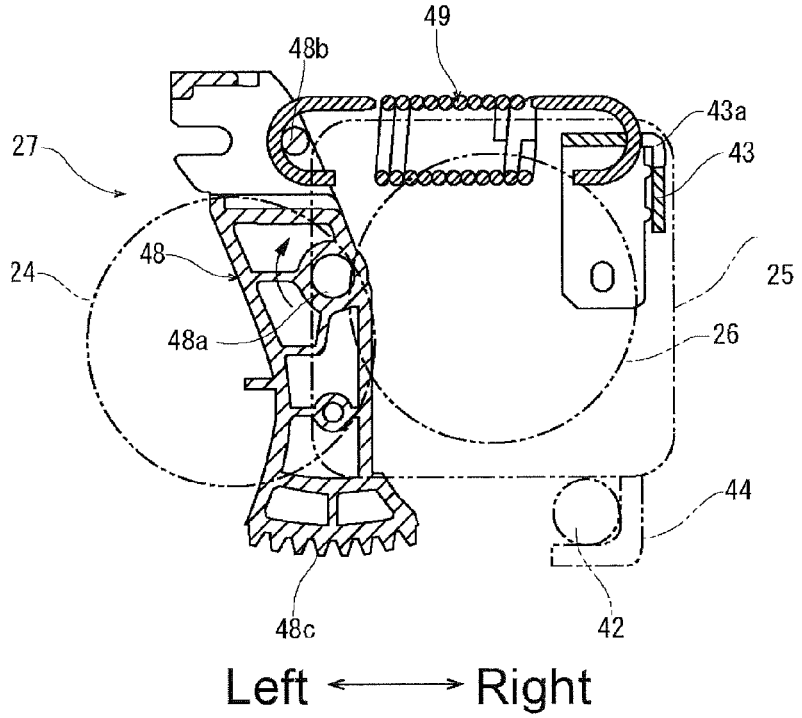
FIGS. 6A to 6B illustrate side cross-sectional views illustrating a moving mechanism in the fixing device according to the one embodiment.
Figure 6B:
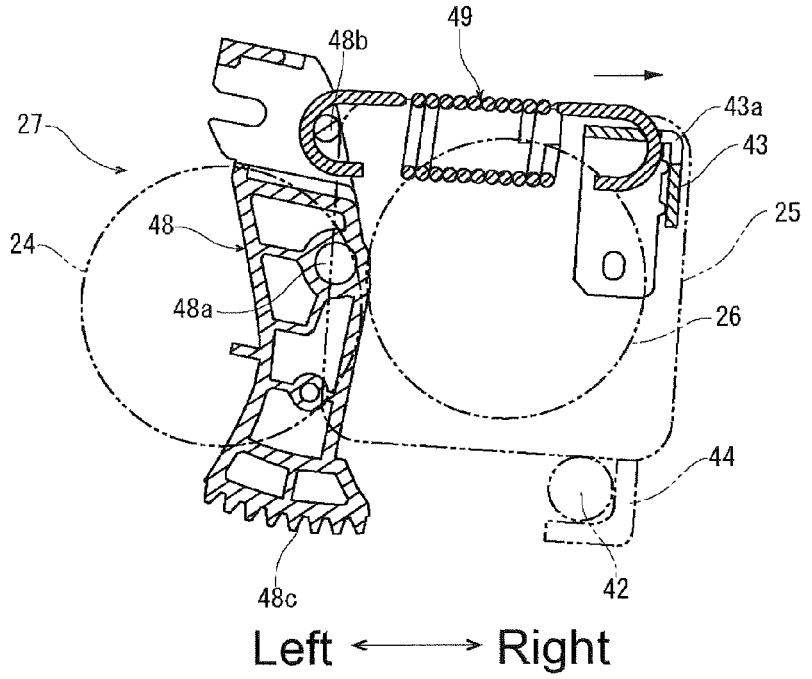

Next, a description will be given of the moving mechanism 27 of the movable housing 25 with reference to FIGS. 6A to 6B. FIGS. 6A to 6B illustrate side views illustrating the moving mechanism 27, FIG. 6A illustrates the moving mechanism 27 in a pressurized state, and FIG. 6B illustrates the moving mechanism 27 in a reduced pressure state.

The moving mechanism 27 includes a lever member 48 and a coil spring 49 outside the front-end surface of the movable housing 25. The lever member 48 is rotatably supported by the movable-housing-containing concave portion 36. The coil spring 49 is interposed between the lever member 48 and the movable housing 25.

The lever member 48 is an approximately rectangular parallelepiped member, and includes a shaft hole 48*a* formed in parallel with the pair of front and rear pivotally supporting pins 42, in the center in a longitudinal direction. In one end portion of the lever member 48, a pin 48*b* is located in parallel with the shaft hole 48*a*. Furthermore, in the other end portion of the lever member 48, gear teeth 48*c* are formed along an arc shape centered at the shaft hole 48*a*. The gear teeth 48*c* are engageable with a drive gear (not illustrated) located in the apparatus main body 2.

A shaft portion (not illustrated) located in the movable-housing-containing concave portion 36 is inserted into the shaft hole 48*a* of the lever member 48. This turnably supports the lever member 48 about the shaft hole 48*a*. One end of the coil spring 49 is engagingly locked to the pin 48*b* of the lever member 48, and the other end of the coil spring 49 is engagingly locked to the opening 43*a* (see FIG. 4) of the connection piece 43 of the movable housing 25.

As illustrated in FIG. 6A, in the moving mechanism 27, the movable housing 25 is biased by the coil spring 49 such that the movable housing 25 turns in the counterclockwise direction about the pivotally supporting pin 42. This causes the pressure roller 26 to be brought into press-contact with the fixing roller 24 and causes the fixing pressure of the fixing nip to be in the pressurized state. The pressurized state causes the fixing roller 24 and the pressure roller 26 to elastically deform with one another and causes a fixing-nip width along the conveyance direction to become wider.

In order to switch the fixing pressure of the fixing nip to the reduced pressure state, the drive gear turns the lever member 48 clockwise about the shaft hole 48*a* (see an arrow in FIG. 6A). Then, the movable housing 25 turns about the pivotally supporting pin 42 in a clockwise direction in FIG. 6A to separate the pressure roller 26 from the fixing roller 24 as illustrated in FIG. 6B, and then, the fixing pressure of the fixing nip is switched from the pressurized state to the reduced pressure state.

Figure 7:
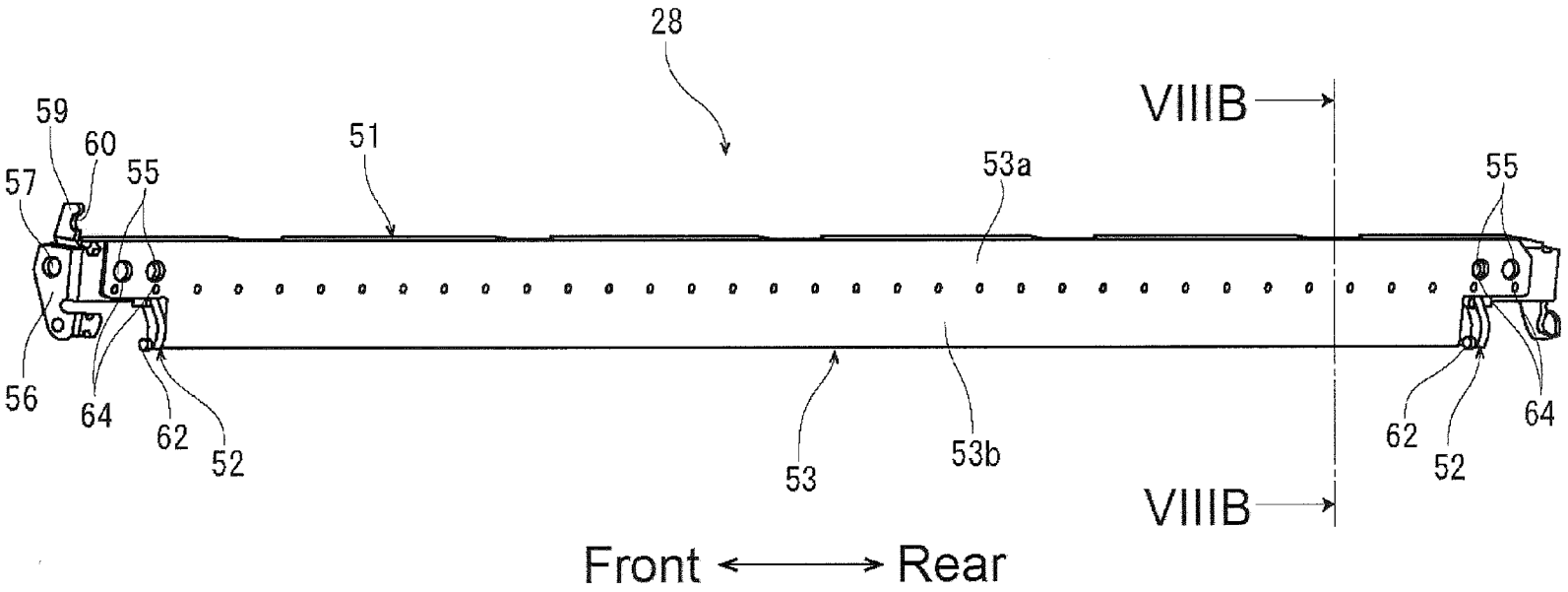
FIG. 7 obliquely illustrates a separating member in the fixing device according to the one embodiment.
Figure 8A:
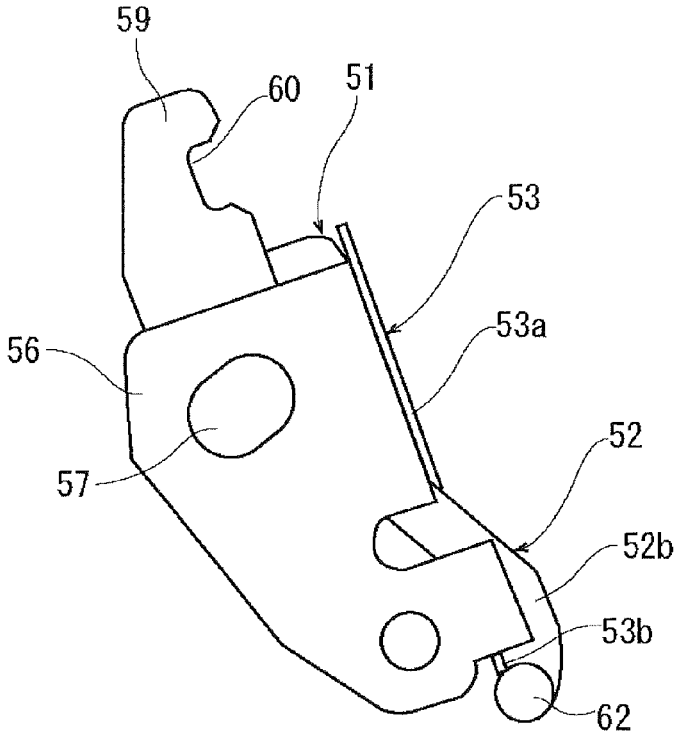
FIGS. 8A to 8B illustrate the separating member in the fixing device according to the one embodiment.
Figure 8B:
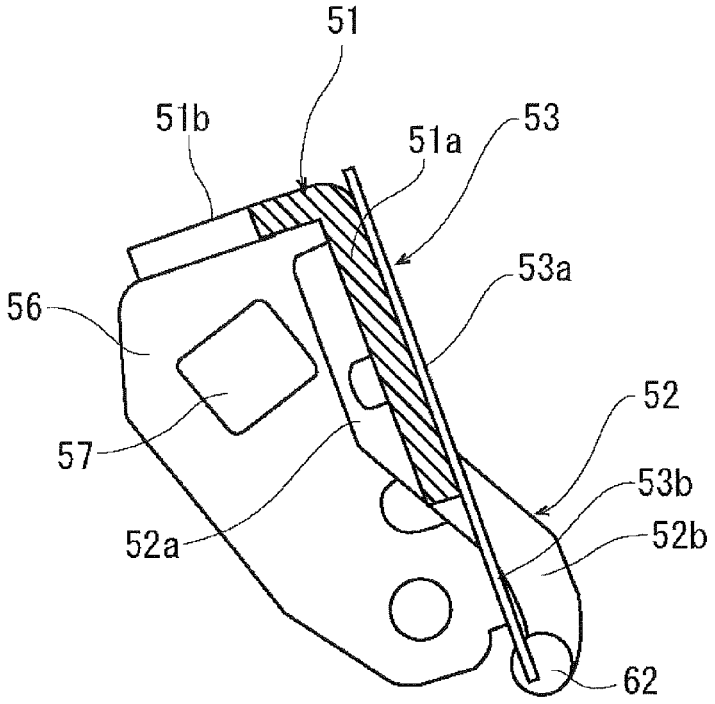

Next, a description will be given of the separating member 28 with reference to FIG. 7 and FIGS. 8A to 8B. FIG. 7 obliquely illustrates the separating member 28. FIGS. 8A to 8B illustrate side views of the separating member 28, FIG. 8A illustrates the side view viewed from the front side of the separating member 28, and FIG. 8B illustrates VIIIB-VIIIB arrow view of FIG. 7.

The separating member 28 is a member long in the axial direction of the rotation shaft of the fixing roller 24. The separating member 28 includes a support plate 51 supported by the fixing-roller-housing concave portion 35 above the fixing roller 24 and includes a pair of contact members 52 and a separation plate 53 secured to the support plate 51.

The support plate 51 is an L-shaped member in side view and includes a supporting portion 51*a* that is orthogonally bent and a regulated portion 51*b*. The pair of contact members 52 and the separation plate 53 are secured to the supporting portion 51*a*. The regulated portion 51*b* is brought into contact with the regulating surface 40*a* (see FIG. 3) of the regulating portion 40 to regulate turning of the separating member 28.

In both front and rear end portions on an outer surface of the supporting portion 51*a*, respective two positioning protrusions 55 are formed at predetermined intervals in a longitudinal direction. Respective mounting portions 56, which are orthogonally bent to an identical direction with the regulated portion 51*b*, are formed in front and rear side edges of the supporting portion 51*a*. Shaft holes 57 are coaxially formed in both the mounting portions 56. As illustrated in FIG. 8A, the shaft hole 57 formed in the front-side mounting portion 56 has an elongated hole shape, and, as illustrated in FIG. 8B, the shaft hole 57 formed in the rear-side mounting portion 56 has a rectangular shape.

In a side edge of a front side of the regulated portion 51*b*, a pressed portion 59, which is orthogonally bent in an opposite direction to the supporting portion 51*a*, is formed. In the pressed portion 59, a cutout 60, which has a rectangular shape, is formed in its side edge on the side of the supporting portion 51*a*.

The pair of contact members 52 each include a fixed portion 52*a* secured to the supporting portion 51*a* of the support plate 51 and a projecting portion 52*b* projecting in an approximately arc shape from the supporting portion 51*a*. An abutting portion 62 is formed at a distal end of the projecting portion 52*b*. The abutting portion 62 has a short columnar shape in parallel with the axial direction of the shaft hole 57. Each fixed portion 52*a* is secured to an inside surface of the supporting portion 51*a* to correspond to the non-paper passing region widthwise outside the fixing roller 24. Thus, the fixed portion 52*a* secured to the supporting portion 51*a* causes the projecting portion 52*b* to project in arc shape to the front side with respect to the supporting portion 51*a* in side view and causes the abutting portion 62, which is formed at the distal end of the projecting portion 52*b*, to project downward with respect to the mounting portion 56.

The separation plate 53 is a rectangular-plate-shaped member that has slightly shorter length than the supporting portion 51*a* of the support plate 51. The separation plate 53 includes a fixed portion 53*a* secured to the supporting portion 51*a* and a projecting portion 53*b* that is extended from the supporting portion 51*a* and has a width narrower than the fixed portion 53*a*. In both front and rear end portions of the fixed portion 53*a*, two positioning holes 64 are formed at predetermined intervals in the longitudinal direction, respectively. Inserting the positioning protrusions 55 of the supporting portion 51*a* into the positioning holes 64 positions the separation plate 53 at the support plate 51. The projecting portion 53*b* is extended by passing through between the pair of projecting portions 52*b* of the contact members 52. The projection length of the projecting portion 53*b* from the supporting portion 51*a* is shorter than the projection length of the pair of projecting portions 52*b* of the contact members 52. In other words, in side view, a predetermine interval is open between a distal-end edge of the projecting portion 53*b* of the separation plate 53 and the pair of abutting portions 62 of the contact members 52.

Engaging the support shaft 38, which is formed in the fixing-roller-housing concave portion 35 of the fixed housing 23, with the shaft hole 57, which is formed in each mounting portion 56 of the support plate 51 turnably supports the separating member 28 about the support shaft 38. In a free posture where the separating member 28 is pivotally supported by the support shaft 38, an upper-end edge of the shaft hole 57 is engagingly locked by the support shaft 38, and the pair of contact members 52 is located below the shaft hole 57, and the separating member 28 turns by its own weight such that the pressed portion 59 is located above the shaft hole 57.

Supporting the fixing roller 24 by the fixing-roller-housing concave portion 35 causes the pair of contact members 52 to be brought into contact with the non-paper passing region of the fixing roller 24 and to be pushed up by the fixing roller 24, and then causes the separating member 28 to turn about the support shaft 38 in the counterclockwise direction in FIG. 3. Subsequently, the pair of abutting portions 62 of the contact members 52 is brought into contact with the non-paper passing region of the fixing roller 24 by its own weight of the separating member 28. This forms a predetermined clearance between the distal-end edge of the projecting portion 53*b* of the separation plate 53 and the paper passing region of the fixing roller 24.

Figure 9:
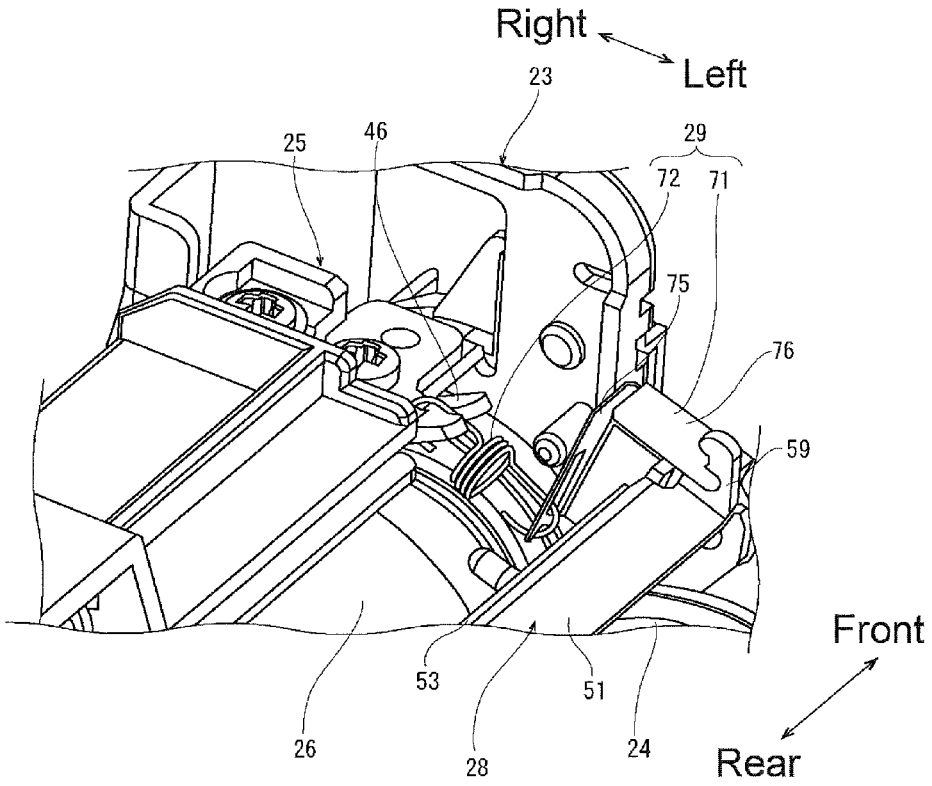
FIG. 9 obliquely illustrates a link member in the fixing device according to the one embodiment.
Figure 10:
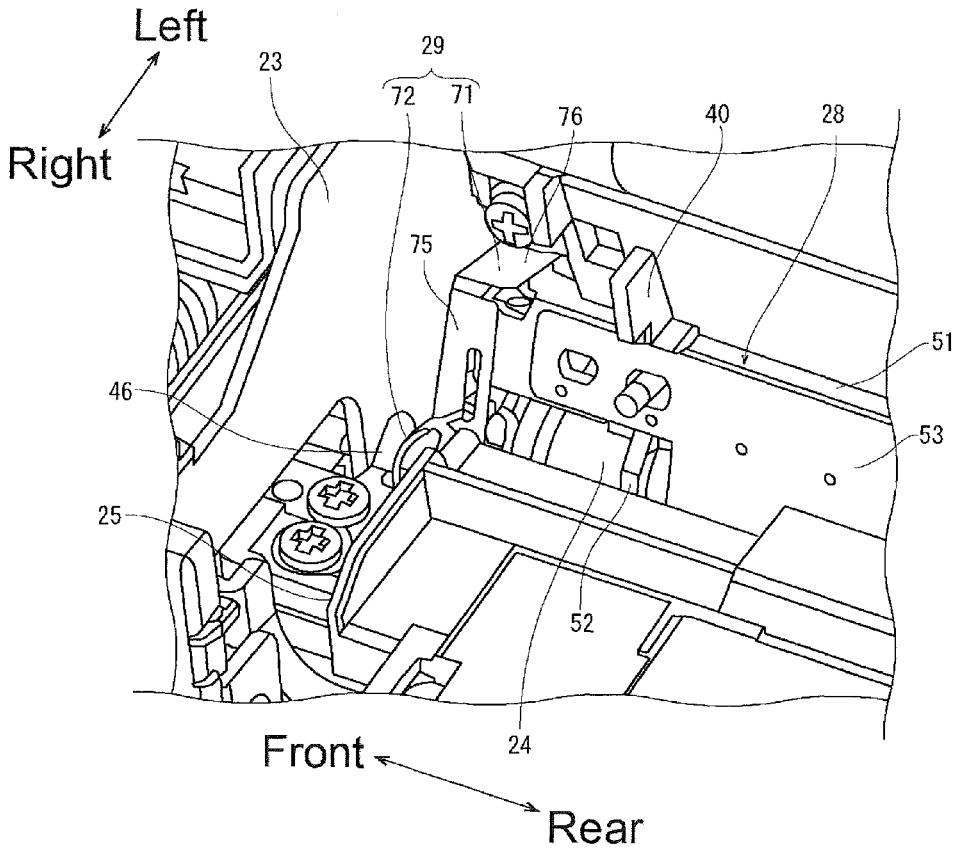
FIG. 10 obliquely illustrates the link member in the fixing device according to the one embodiment.

Next, a description will be given of the link member 29 with reference to FIGS. 9 to 12. FIGS. 9 and 10 obliquely illustrate the link member 29, FIG. 11 obliquely illustrates a link plate 71, and FIG. 12 obliquely illustrates the link plate 71 mounted on a front end of the separating member 28.

The link member 29 includes the link plate 71 and a coil spring 72 and is interposed between the separating member 28 and the movable housing 25, as illustrated in FIGS. 9 and 10.

Figure 11:
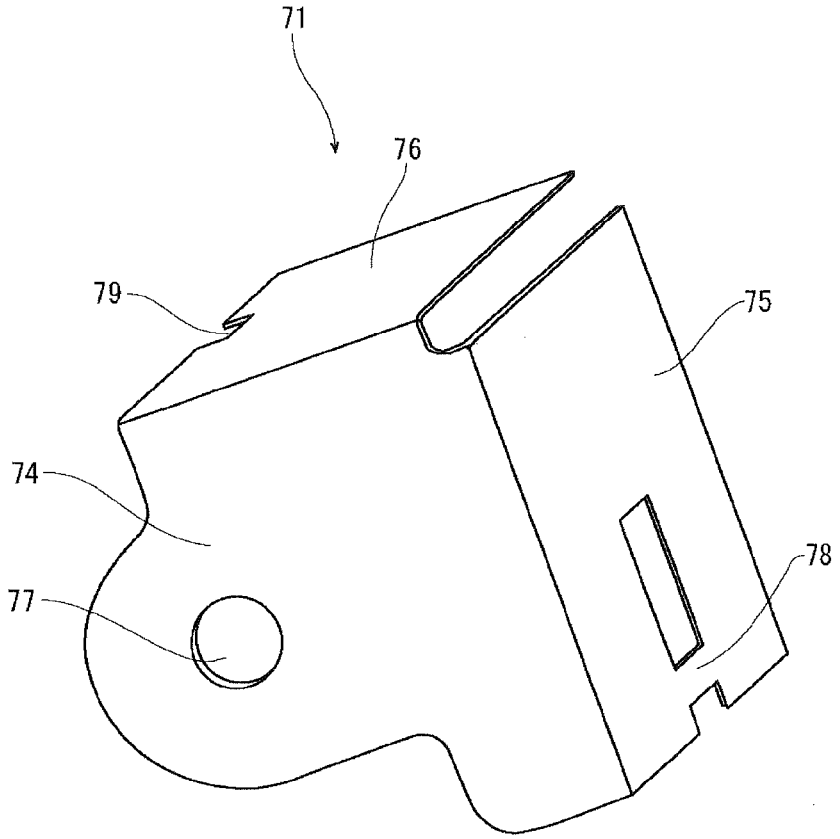
FIG. 11 obliquely illustrates a link plate in the fixing device according to the one embodiment.

As illustrated in FIG. 11, the link plate 71 includes a mounting piece 74, a connection piece 75, and a pressing piece 76. The mounting piece 74 has two sides that are orthogonal to one another. The connection piece 75 and the pressing piece 76 are orthogonally bent to an identical direction from the two orthogonal sides of the mounting piece 74. In the mounting piece 74, a circular shaft hole 77 is formed. In the connection piece 75, a spring lock portion 78 is formed on a side edge, which is on a side opposite to the pressing piece 76. The spring lock portion 78 is formed between a cutout and an oblong hole. In the pressing piece 76, a cutout 79 is formed on an edge, which is on a side opposite to the connection piece 75.

Figure 12:
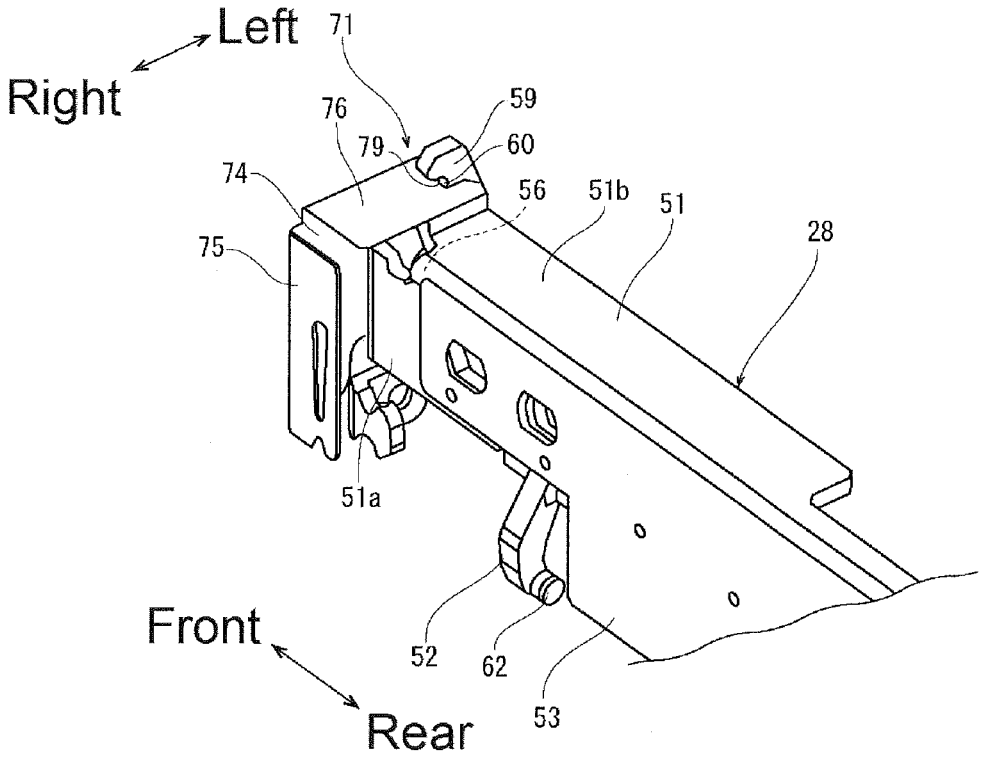
FIG. 12 obliquely illustrates the separating member and the link member in the fixing device according to the one embodiment.

As illustrated in FIG. 12, the link plate 71 is connected to the front end of the separating member 28. In the link plate 71, the shaft hole 77 of the mounting piece 74 engages with the support shaft 38, which is formed in the fixing-roller-housing concave portion 35, in a posture where the mounting piece 74 becomes the outside of the mounting portion 56 of the separating member 28, the connection piece 75 becomes the outside of the supporting portion 51*a*, and the pressing piece 76 becomes the outside of the regulated portion 51*b*. That is, similarly to the separating member 28, the link plate 71 turns about the support shaft 38. The cutout 79 of the pressing piece 76 engages with the cutout 60 of the pressed portion 59 of the separating member 28.

One end of the coil spring 72 is engagingly locked to the spring lock portion 78 of the connection piece 75 of the link plate 71, and the other end is engagingly locked to the spring mounting portion 46 of the movable housing 25.

Next, a description will be given of the IH unit 21 with reference to FIG. 2. The IH unit 21 includes a coil portion 91, a coil bobbin 92 that holds the coil portion 91 in a winding shape, and an arch core 93. The IH unit 21 is mounted so as to cover the left side surface opening 23*b* of the fixed housing 23 and covers the outer peripheral surface of the fixing roller 24 exposed from the left side surface opening 23*b*. Applying a high-frequency A.C. voltage to the coil portion 91 causes the coil portion 91 to generate a magnetic field. The action of the magnetic field generates an eddy current in the base material layer of the fixing roller 24, and the base material layer produces heat to heat the fixing roller 24.

Figure 13:
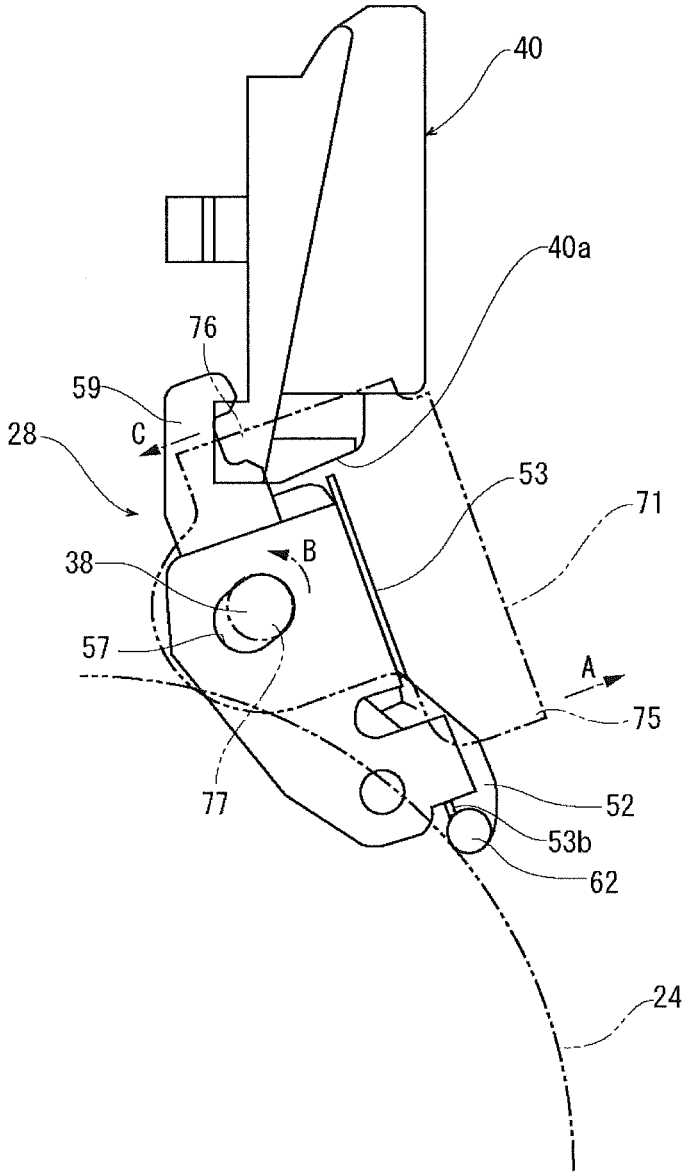
FIG. 13 illustrates a side view illustrating the separating member in the pressurized state in the fixing device according to the one embodiment.
Figure 14:
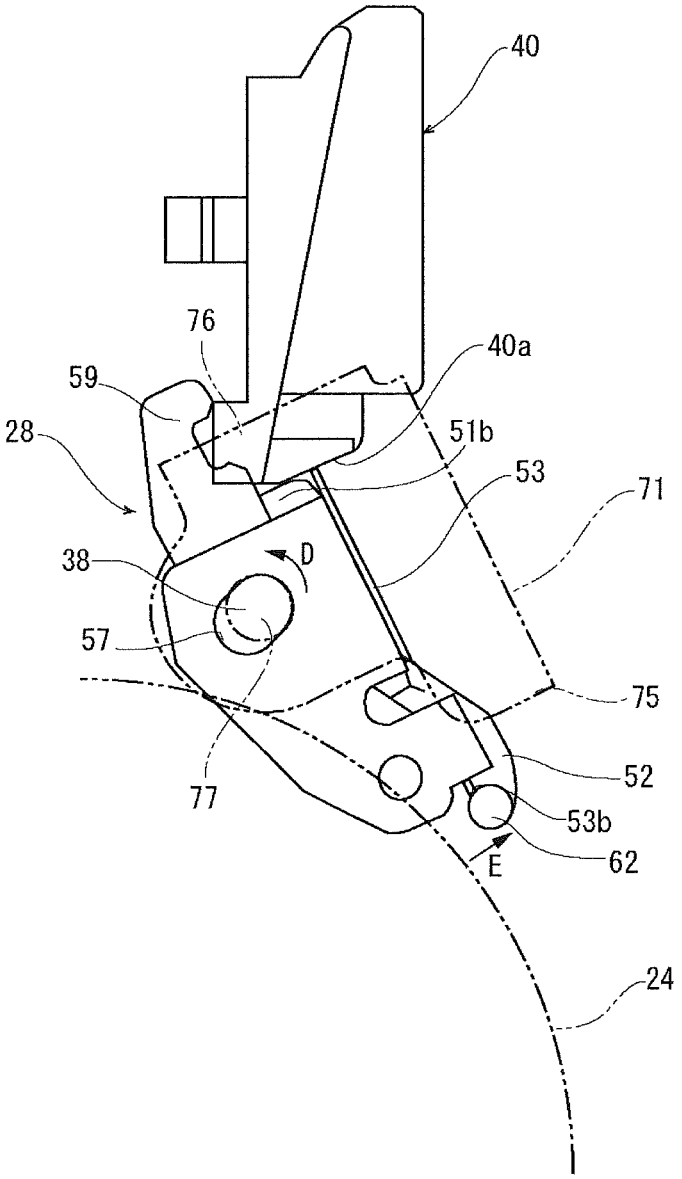
FIG. 14 illustrates a side view illustrating the separating member in the reduced pressure state in the fixing device according to the one embodiment.
Figure 15:
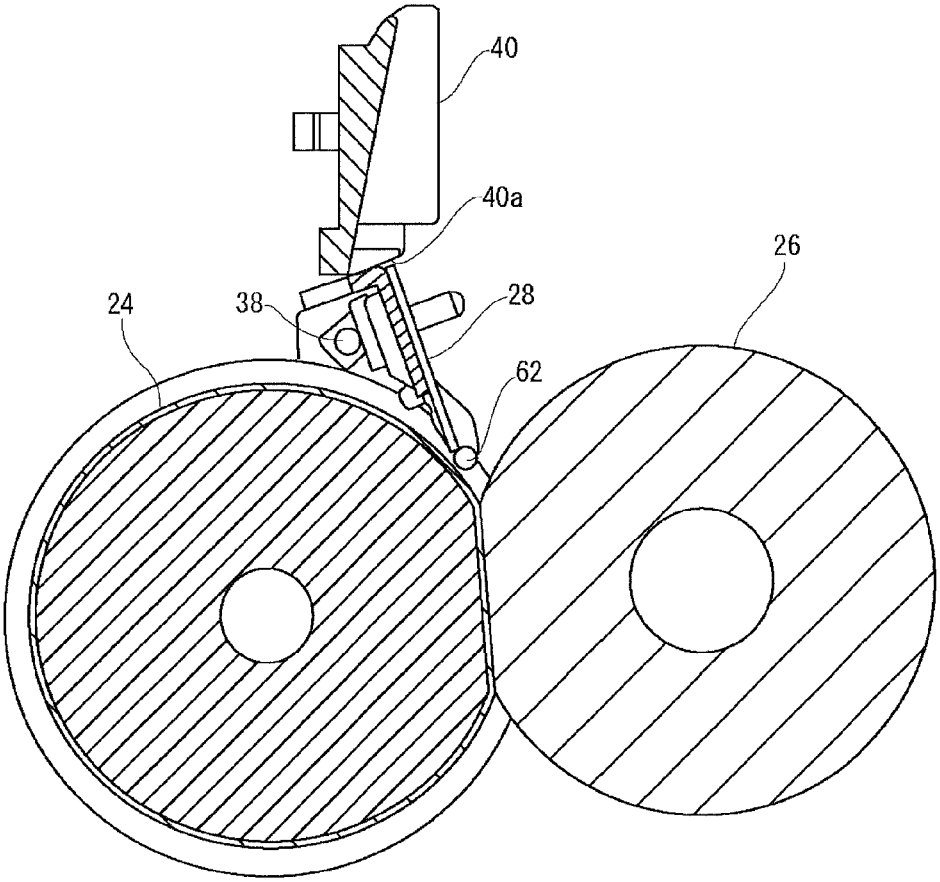
FIG. 15 illustrates a side cross-sectional view illustrating the fixing roller, the pressure roller, and the separating member in the pressurized state in the fixing device according to the one embodiment.
Figure 16:
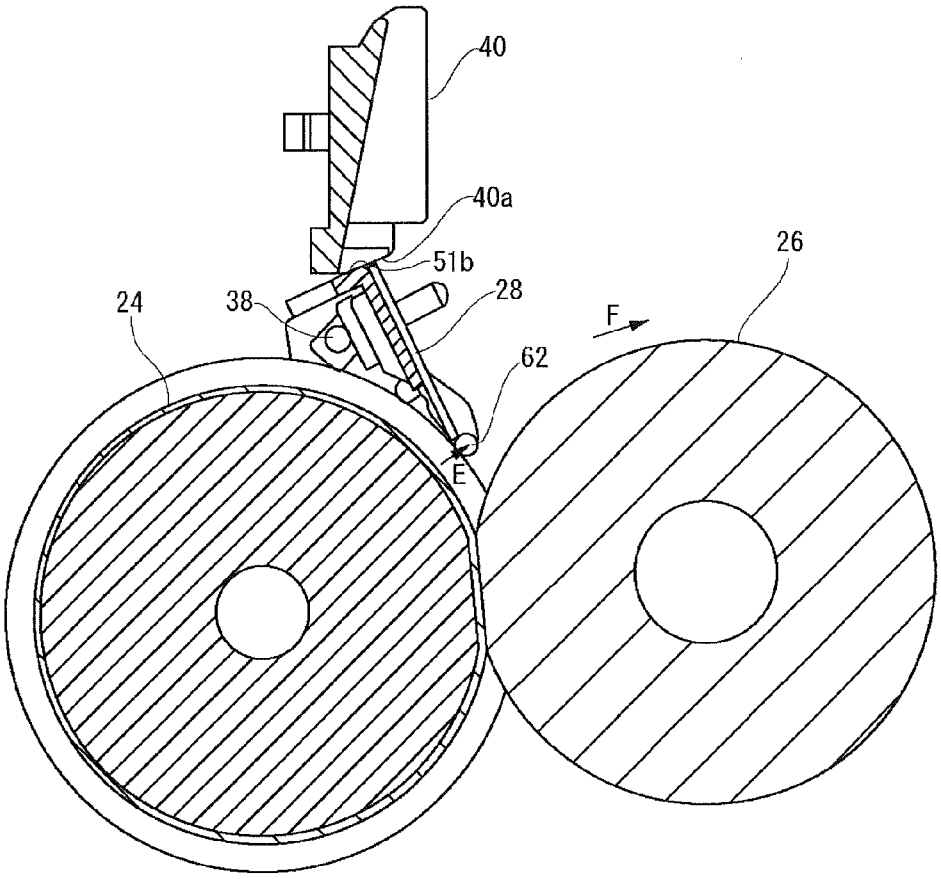
FIG. 16 illustrates a side cross-sectional view illustrating the fixing roller, the pressure roller, and the separating member in the reduced pressure state in the fixing device according to the one embodiment.

In the fixing device 7 having the above-described structure, a description will be given of the behavior of the separating member 28 in switching the fixing pressure from the pressurized state to the reduced pressure state with reference to FIGS. 13 to 16. FIGS. 13 and 14 illustrate side views illustrating the separating member 28, FIG. 13 illustrates the pressurized state, and FIG. 14 illustrates the reduced pressure state. FIGS. 15 and 16 illustrate side cross-sectional views illustrating the fixing roller 24 and the pressure roller 26, FIG. 15 illustrates the pressurized state, and FIG. 16 illustrates the reduced pressure state.

When the paper sheet is a plain paper, the fixing pressure of the fixing nip is switched to the pressurized state. As illustrated in FIGS. 13 and 15, as described above, turning of the separating member 28 by its own weight causes the pair of abutting portions 62 of the contact members 52 to be brought into contact with the non-paper passing region of the fixing roller 24. This ensures a predetermined clearance between the distal-end edge of the projecting portion 53*b* of the separation plate 53 and the paper passing region of the fixing roller 24. The coil spring 72 of the link member 29 is in a free length, and the link plate 71 is not biased by the coil spring 72.

After the plain paper passes through the fixing nip with the toner image fixed, the distal end of the plain paper is separated from the fixing roller 24 by the distal-end edge of the projecting portion 53*b* of the separation plate 53.

On the other hand, when the paper sheet is a cardboard such as an envelope, the movable housing 25 turns about the pivotally supporting pin 42 in a separation direction from the fixing roller 24 by the moving mechanism 27 (see FIGS. 6A to 6B), and the pressure roller 26 separates from the fixing roller 24 (see an arrow F in FIG. 16) to switch the fixing pressure of the fixing nip to the reduced pressure state. Turning of the movable housing 25 in the separation direction from the fixing roller 24 causes the coil spring 72 of the link member 29 to pull the connection piece 75 of the link plate 71 (see an arrow A in FIG. 13). This causes the link plate 71 to turn about the support shaft 38 in the counterclockwise direction in FIG. 13 (see an arrow B in FIG. 13) and causes the pressing piece 76 to press the pressed portion 59 of the separating member 28 (see an arrow C in FIG. 13).

Then, the separating member 28 turns about the support shaft 38 in the counterclockwise direction in FIG. 13 (see an arrow D in FIG. 14), and the pair of abutting portions 62 of the contact members 52 separates from the non-paper passing region of the fixing roller 24 (see an arrow E in FIGS. 14 and 16). As illustrated in FIG. 14, the separating member 28 turns until an outer surface of the regulated portion 51*b* of the support plate 51 is brought into contact with the regulating surface 40*a* of the regulating portion 40. When the movable housing 25 turns after the outer surface of the regulated portion 51*b* is brought into contact with the regulating surface 40*a* of the regulating portion 40, the amount of movement of the movable housing 25 is absorbed by expansion and contraction of the coil spring 72. That is, the separating member 28 constantly turns only up to a constant position (the position where the outer surface of the regulated portion 51*b* is brought into contact with the regulating surface 40*a* of the regulating portion 40) with respect to the fixing roller 24.

After the cardboard passes through the fixing nip with the toner image fixed, the distal end of the cardboard is separated from the fixing roller 24 by the distal end of the projecting portion 53*b* of the separation plate 53.

As described above, according to the fixing device 7 of the disclosure, switching the fixing pressure of the fixing nip to the reduced pressure state causes the separating member 28 to turn until the outer surface of the regulated portion 51*b* of the support plate 51 is brought into contact with the regulating surface 40*a* of the regulating portion 40. That is, the separating member 28 constantly turns only up to the constant position with respect to the fixing roller 24.

The separating member 28 is rotatably supported by the support shaft 38 located in the fixed housing 23, and the regulating portion 40 is also located in the fixed housing 23. The fixing roller 24 is also rotatably supported by the fixed housing 23. In view of this, since the positional relationship between the separating member 28, which turns until it is brought into contact with the regulating portion 40, and the fixing roller 24 is constantly identical, the clearance between the separating member 28 and the fixing roller 24 in the reduced pressure state is stably controllable. Consequently, switching the fixing pressure to the reduced pressure state not only ensures long life of the fixing roller 24 by setting the fixing roller 24 and the pair of contact members 52 contactless but also ensures stable control of the clearance between a distal-end edge of the separation plate 53 and the paper passing region of the fixing roller 24 in the reduced pressure state.

Pivotally supporting the separating member 28 by the support shaft 38 in the shaft hole 57 having the elongated hole shape ensures keeping the clearance between the distal-end edge of the separation plate 53 and the paper passing region constant, by causing the support shaft 38 to move inside the shaft hole 57 and then causing the pair of abutting portions 62 of the contact members 52 to be brought into contact with the non-paper passing region, when parallelism between the distal-end edge of the projecting portion 53*b* of the separation plate 53 and the paper passing region of the fixing roller 24 is deviated by, for example, deformation of the separation plate 53.

In switching from the pressurized state to the reduced pressure state, since the pressed portion 59 located above the shaft hole 57 is pressed, the separating member 28 turns about the support shaft 38. In the pressurized state, the support shaft 38 is engagingly locked at the upper-end edge of the shaft hole 57 by its own weight of the separating member 28. Thus, the position of the support shaft 38 inside the shaft hole 57 is not varied when the pressed portion 59 located above the shaft hole 57 is pressed and then the separating member 28 turns.

In contrast to this, for example, when a lower portion than the shaft hole 57 of the separating member 28 is pressed or pulled and then the separating member 28 turns about the support shaft 38, the support shaft 38 may relatively move downward inside the shaft hole 57 during the turning of the separating member 28 because of the upward force applied to the separating member 28. Then, the relative position between the support shaft 38 and the separating member 28 varies and then the clearance between the separating member 28 and the fixing roller 24 in the reduced pressure state varies.

Consequently, as the disclosure, turning the separating member 28 by pressing the pressed portion 59 on the upper side with respect to the shaft hole 57 ensures maintaining the relative position between the support shaft 38 and the separating member 28 constant.

Furthermore, the link plate 71 is turnably supported about the support shaft 38 in the same way as the separating member 28. The cutout 79 of the pressing piece 76 of the link plate 71 engages with the cutout 60 of the pressed portion 59 of the separating member 28 with one another. Consequently, when the link plate 71 turns by switching to the reduced pressure state, the cutout 79 of the pressing piece 76 and the cutout 60 of the pressed portion 59 move along a turning orbit having an approximately identical radius about the support shaft 38. This always keeps the clearance between the cutout 60 of the pressed portion 59 and the support shaft 38 constant, and thus ensures maintaining the relative position between the support shaft 38 and the separating member 28 constant.

The link member 29 is located only between a front-end portion of the separating member 28 and the front-end portion of the movable housing 25, and thus this ensures cost reduction. The link member 29 may be also located between a rear-end portion of the separating member 28 and a rear-end portion of the movable housing 25. Thus, the link member 29 is interposed between end portions of one of each of the movable housing 25 and the separating member 28 in the axial direction of the support shaft 38. This ensures the simplified configuration of the fixing device 7.

While the embodiment of the disclosure has been described when the structure of the disclosure is applied to the printer 1, in other different embodiments, the structure of the disclosure may be applied to an image forming apparatus other than the printer 1, such as a copier, a facsimile, and a multi-functional peripheral.

Furthermore, since the description of the above-described embodiment of the disclosure has described the preferred embodiment in the fixing device and the image forming apparatus according to the disclosure, various kinds of limitations, which are technically preferred, may be designated; however, the technical scope of the disclosure is not limited by these aspects unless there is description that limits the disclosure in particular. That is, the above-described components in the embodiments of the disclosure are replaceable with, for example, the existing components as appropriate, and various variations including a combination with other existing components can be employed, and thus, the description of the above-described embodiment of the disclosure does not limit the contents of the disclosure described in the claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device comprising:

a fixing member that is heated;

a pressure member that forms a fixing nip with the fixing member;

a fixed housing that rotatably supports the fixing member;

a movable housing that rotatably supports the pressure member and is separably located with respect to the fixed housing;

a moving mechanism that moves the movable housing in a direction where the movable housing approaches to or separates from the fixed housing and switches a fixing pressure of the fixing nip between a pressurized state and a reduced pressure state;

a separating member that is turnably supported by the fixed housing about a support shaft in a direction where the separating member approaches to or separates from the fixing member and separates a paper sheet that has passed through the fixing nip from the fixing member;

a regulating portion that is located in the fixed housing and regulates turning of the separating member in a direction where the separating member separates from the fixing member; and a link member that is interposed between the movable housing and the separating member, wherein, in the pressurized state, the separating member turns about the support shaft in a direction where the separating member approaches to the fixing member by its own weight of the separating member, and when the fixing pressure is switched from the pressurized state to the reduced pressure state, moving the movable housing in the direction where the movable housing separates from the fixed housing by the moving mechanism causes the separating member to turn about the support shaft via the link member in the direction where the separating member separates from the fixing member and causes the regulating portion to regulate turning of the separating member.

2. The fixing device according to claim 1, wherein the separating member includes:

a separation plate that is opposed to a paper passing region of the paper sheet in the fixing member;

an abutting portion that ensures contact with a non-paper passing region outside the paper passing region in the fixing member;

a mounting portion where a shaft hole into which the support shaft is inserted is formed; and a pressed portion that is pressed by the link member, turning of the mounting portion about the support shaft in one direction by its own weight of the separating member causes the abutting portion to be brought into contact with the non-paper passing region and forms a clearance between the separation plate and the paper passing region in the pressurized state and turning of the mounting portion about the support shaft in a direction opposite to the one direction by the pressed portion being pressed by the link member causes the abutting portion to separate from the non-paper passing region in the reduced pressure state.

3. The fixing device according to claim 2, wherein the shaft hole is an oblong hole, and when the separating member is pivotally supported by the support shaft, the separating member turns by its own weight such that the abutting portion is located below the shaft hole while the pressed portion is located above the shaft hole.

4. The fixing device according to claim 2, wherein the link member includes:

an elastic member connected to the movable housing; and a link plate interposed between the elastic member and the separating member, wherein the link plate includes:

a mounting piece where a shaft hole into which the support shaft is inserted is formed, the mounting piece being turnably located about the support shaft;

a pressing piece that ensures contact with the pressed portion of the separating member; and a connection piece connected to the elastic member, wherein in the reduced pressure state, turning of the mounting piece about the support shaft by the connection piece being pulled by the elastic member causes the pressing piece to press the pressed portion of the separating member.

5. The fixing device according to claim 1, wherein the link member is interposed between end portions of one of each of the movable housing and the separating member in an axial direction of the support shaft.

6. An image forming apparatus comprising the fixing device according to claim 1.

* * * * *